US010201734B2

(12) United States Patent
Pactanac et al.

(10) Patent No.: US 10,201,734 B2
(45) Date of Patent: Feb. 12, 2019

(54) GOLF BAG ACCESSORY BAG

(71) Applicant: NIKE, Inc., Beaverton, OR (US)

(72) Inventors: Pierre Pactanac, Portland, OR (US); Heather LeAnne Herron, Portland, OR (US); Mark Andrew Alan, Portland, OR (US); Harlan Charles Peden, III, Sunbury, OH (US); Sherry Lynn Jones, Pataskala, OH (US); James Huang Lua, Columbus, OH (US)

(73) Assignee: NIKE, Inc., Beaverton, OR (US)

( * ) Notice: Subject to any disclaimer, the term of this patent is extended or adjusted under 35 U.S.C. 154(b) by 229 days.

(21) Appl. No.: 14/884,166

(22) Filed: Oct. 15, 2015

(65) Prior Publication Data

US 2017/0106256 A1 Apr. 20, 2017

(51) Int. Cl.
*A63B 55/00* (2015.01)

(52) U.S. Cl.
CPC ..... *A63B 55/408* (2015.10); *A63B 55/00* (2013.01)

(58) Field of Classification Search
CPC ..... A63B 55/00; A63B 55/10; A63B 55/007; A63B 55/008; A63B 55/005
USPC ..... 206/315.2, 315.8, 315.3, 315.5, 315.6, 206/315.7; 190/108, 18 A; 224/274, 224/413, 583, 645
See application file for complete search history.

(56) References Cited

U.S. PATENT DOCUMENTS 4,350,194 A * 9/1982 Brown ..... A63B 55/00 206/315.5
5,176,253 A 1/1993 Perrin et al.
5,860,519 A * 1/1999 Meyer ..... A63B 55/00 206/315.3
6,499,593 B1 * 12/2002 Uner ..... A45C 7/0045 206/315.3

(Continued)

FOREIGN PATENT DOCUMENTS

DE 102009004140 A1 7/2010
WO WO-2013056098 A1 4/2013

OTHER PUBLICATIONS

European Patent Office as the International Searching Authority, International Search Report and Written Opinion for PCT Application No. PCT/US2016/056997, dated Feb. 21, 2017.

*Primary Examiner* — Fenn C Mathew
*Assistant Examiner* — Cynthia Collado
(74) *Attorney, Agent, or Firm* — Honigman Miller Schwartz and Cohn LLP; Matthew H. Szalach; Jonathan P. O'Brien

(57) ABSTRACT

A pocket for a golf bag includes a main body defining a storage compartment. The pocket includes a first attachment mechanism movable between an attached state attaching the main body to a first attachment location of the golf bag and a detached state allowing the main body to be separated from the first attachment location. The pocket also includes a second attachment mechanism movable between an attached state attaching the main body to a second attachment location of the golf bag and a detached state allowing the main (Continued)

body to be separated from the second attachment location. The pocket includes a carry mechanism operable to allow the main body to be carried separately from the golf bag when the first attachment mechanism is in the detached state and the second attachment mechanisms is in the detached state.

20 Claims, 8 Drawing Sheets

(56) References Cited

U.S. PATENT DOCUMENTS

| | | | | |
|---|---|---|---|---|
| 6,520,327 | B1 * | 2/2003 | Boardman | A45C 7/0086 206/315.4 |
| 9,302,162 | B1 * | 4/2016 | Foxman | A63B 55/008 |
| 9,713,754 | B2 * | 7/2017 | Herron | A63B 55/00 |
| 2003/0094390 | A1 * | 5/2003 | Thompson | A63B 55/408 206/315.5 |
| 2008/0264814 | A1 * | 10/2008 | Campbell | A63B 55/00 206/315.5 |
| 2009/0181788 | A1 * | 7/2009 | O'Connor | A63B 21/0004 473/286 |
| 2009/0261600 | A1 * | 10/2009 | D'Ambrosio | A45C 13/1069 292/251.5 |
| 2014/0061075 | A1 * | 3/2014 | Leposky | A63B 55/00 206/315.3 |
| 2014/0318998 | A1 | 10/2014 | Loudenslager et al. | |
| 2015/0060221 | A1 | 3/2015 | Bourette | |
| 2017/0106257 | A1 * | 4/2017 | Pactanac | A63B 55/40 |

* cited by examiner

GOLF BAG ACCESSORY BAG

FIELD

The present disclosure relates to a golf bag and more particularly to a golf bag having one or more detachable accessory bags.

BACKGROUND

This section provides background information related to the present disclosure and is not necessarily prior art.

Golf bags are standard equipment in the game of golf for holding and transporting golf clubs. A golf bag conventionally includes a tubular construction with a closed bottom, an open top, and a carrying strap attached between the closed bottom and the open top. The open top receives one or more golf clubs while the closed bottom and an outer skin or shell of the golf bag defines an interior void to contain the one or more golf clubs. The outer skin or shell may be formed from materials and may be reinforced by a frame formed by one or more support members, such as rails or poles, thereby holding the bag in an open and taut state.

Golf bags are generally designed to include a variety of accessory compartments for holding golf-related items such as golf balls, tees, and towels, as well as for personal items such as beverages, mobile phones, and shoes. Such compartments are permanently attached to the golf bag and, as such, remain part of the bag regardless of whether the golfer utilizes the compartment. While most golfers will sacrifice an increase in size and weight of a golf bag to allow for added storage, the additional size and weight caused by such compartments can lead to fatigue when carrying the golf bag and, as such, can have an adverse effect on the golfer's performance. Further, when such compartments are not used or are used infrequently, the extra size and weight of such pockets becomes a detriment to the golfer's performance without providing any benefit. This adverse effect is generally tolerated because the compartments add utility in certain situations and cannot be removed from the golf bag.

In addition to the foregoing, while conventional golf bag pockets and compartments provide utility when golfing and between rounds of golf (i.e., to store equipment such as golf balls, tees, and the like), such pockets cannot be removed from the bag for other uses. Namely, golfers do not have the ability to add and remove accessory pockets or compartments from a golf bag to utilize such compartments separately from the golf bag. For instance, after a round of golf, a golfer may need to transport gym shoes stored in a designated accessory compartment for use in another activity. Here, the golfer either needs to remove the gym shoes and place them in a separate bag or transport the entire golf bag along with the other contents of the golf bag. Moreover, golf bags are generally stored outside of the golfer's home due to their size and weight, thereby requiring the golfer to transport items that the golfer desires to use on a particular day between multiple locations in order to pack accessory compartments of the golf bag. Thus, conventional golf bags do not provide a golfer with the ability to pre-pack a golf bag with items or to use accessory compartments separately from the golf bag.

DRAWINGS

The drawings described herein are for illustrative purposes only of selected configurations and are not intended to limit the scope of the present disclosure.

Figure 9:
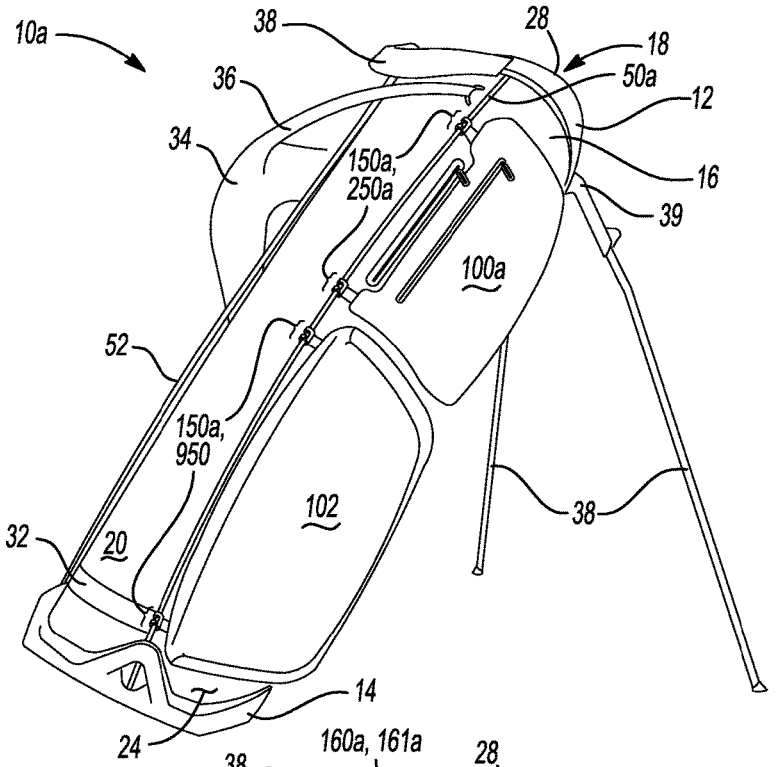
FIG. 9 is a perspective view of a golf bag having a first detachable accessory bag and a second detachable accessory bag in accordance with principles of the present disclosure.
Figure 12:
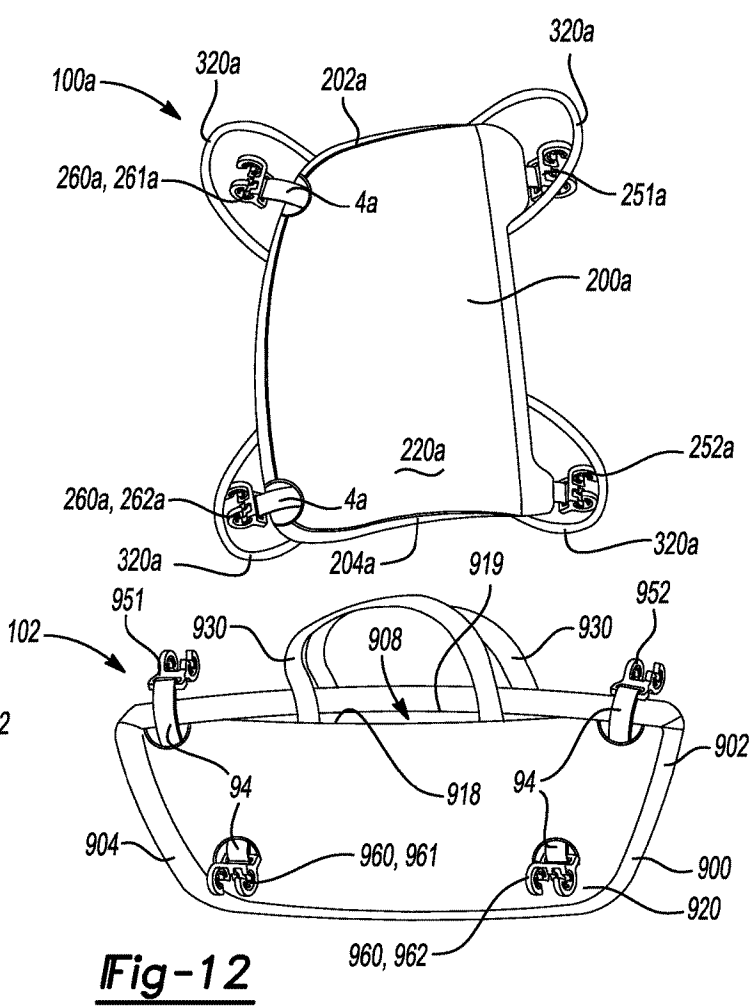
Figure 11:
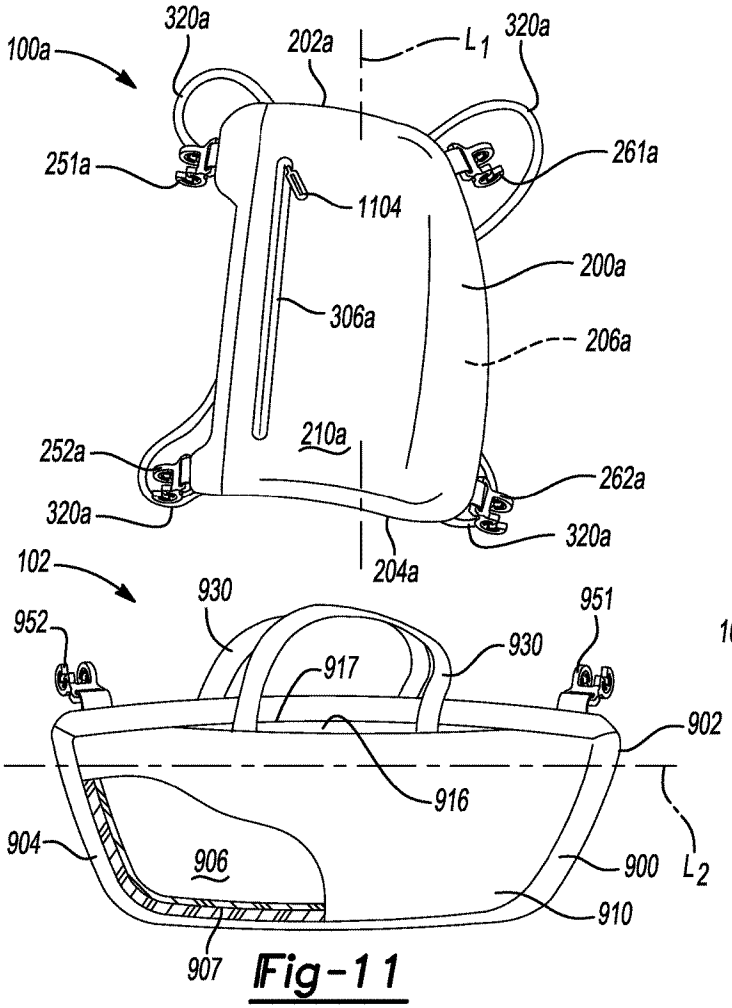

FIG. 11 is a front perspective view of the first detachable accessory bag and the second detachable accessory bag of FIG. 9 each having one or more carry mechanisms with a portion of an outer wall of the second detachable accessory bag removed to show an internal compartment of the second detachable accessory bag; and FIG. 12 is a rear perspective view of the first detachable accessory bag and the second detachable accessory bag of FIG. 9 showing each of the detachable accessory bags including a respective first series of attachment mechanisms and a respective second series of attachment mechanisms.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

With reference to the figures and in one aspect of the disclosure, a pocket for a golf bag is provided and includes a main body defining a storage compartment. A first attachment mechanism is movable between an attached state attaching the main body to a first attachment location of the golf bag and a detached state allowing the main body to be separated from the first attachment location. A second attachment mechanism is movable between an attached state attaching the main body to a second attachment location of the golf bag and a detached state allowing the main body to be separated from the second attachment location. The pocket also includes a carry mechanism that allows the main body to be carried separately from the golf bag when the first attachment mechanism is in the detached state and the second attachment mechanism is in the detached state.

In some implementations, the second attachment mechanism is spaced apart from the first attachment mechanism in a direction substantially parallel to a longitudinal axis of the main body. The carry mechanism may be different than the first attachment mechanism and the second attachment mechanism and, in some examples, the carry mechanism includes a strap attached to the main body at a first location and at a second location. In these examples, the second location is spaced apart from the first location in a direction substantially parallel to a longitudinal axis of the main body.

In some examples, the main body includes a closure device that selectively prevents access to the storage compartment. The main body may include a first end and a second end disposed at an opposite end of the main body than the first end. Optionally, one of the first end and the second end includes a first closure device that prevents access to the storage compartment via a first opening in a closed state and permits access to the storage compartment via the first opening in an open state. Additionally or alternatively, a second closure device may be associated with the other one of the first end and the second end and is movable between an open state and a closed state. The second closure device may permit a pocket extension disposed within the storage compartment to be moved through the second opening and extend from the main body to increase a volume of the storage compartment. Here, an axis that passes through the first opening may likewise pass through the second opening and into the pocket extension.

In some configurations, the main body is selectively movable into an extended state to increase a volume of the storage compartment when the first attachment mechanism and the second attachment mechanism are in the detached state. The extended state may provide the main body with an increased length in a direction substantially parallel to a longitudinal axis of the main body.

In another aspect of the disclosure, a pocket for a golf bag is provided and includes a main body defining a storage compartment. A first attachment mechanism is movable between an attached state attaching the main body to a first attachment location of the golf bag and a detached state allowing the main body to be separated from the first attachment location. A second attachment mechanism is movable between an attached state attaching the main body to a second attachment location of the golf bag and a detached state allowing the main body to be separated from the second attachment location. The pocket also includes a pocket extension in fluid communication with the storage compartment and movable from a retracted state disposed within the main body and an extended state extending from the main body. The pocket extension increases a volume of the storage compartment when in the extended state.

In some implementations, the second attachment mechanism is spaced apart from the first attachment mechanism in a direction substantially parallel to a longitudinal axis of the main body. Optionally, the pocket also includes a carry mechanism that allows the main body to be carried separately from the golf bag when the first attachment mechanism is in the detached state and the second attachment mechanism is in the detached state. The carry mechanism may be different than the first attachment mechanism and the second attachment mechanism and, in some examples, the carry mechanism includes a strap attached to the main body at a first location and at a second location. In these examples, the second location is spaced apart from the first location in a direction substantially parallel to a longitudinal axis of the main body.

In some configurations, the main body includes a closure device that selectively prevents access to the storage compartment. The main body may include a first end and a second end disposed at an opposite end of the main body than the first end. Optionally, one of the first end and the second end includes a first closure device that prevents access to the storage compartment via first opening in a closed state and permits access to the storage compartment via the first opening in an open state. Additionally or alternatively, a second closure device may be associated with the other one of the first end and the second end and is movable between an open state and a closed state. The second closure device may permit the pocket extension to move into the extended state when the second closure device is in the open state. Here, an axis that passes through the first opening may likewise pass through the second opening and into the pocket extension. The pocket extension optionally provides the main body with an increased length in a direction substantially parallel to a longitudinal axis of the main body when the pocket extension is in the extended state.

Figure 1:
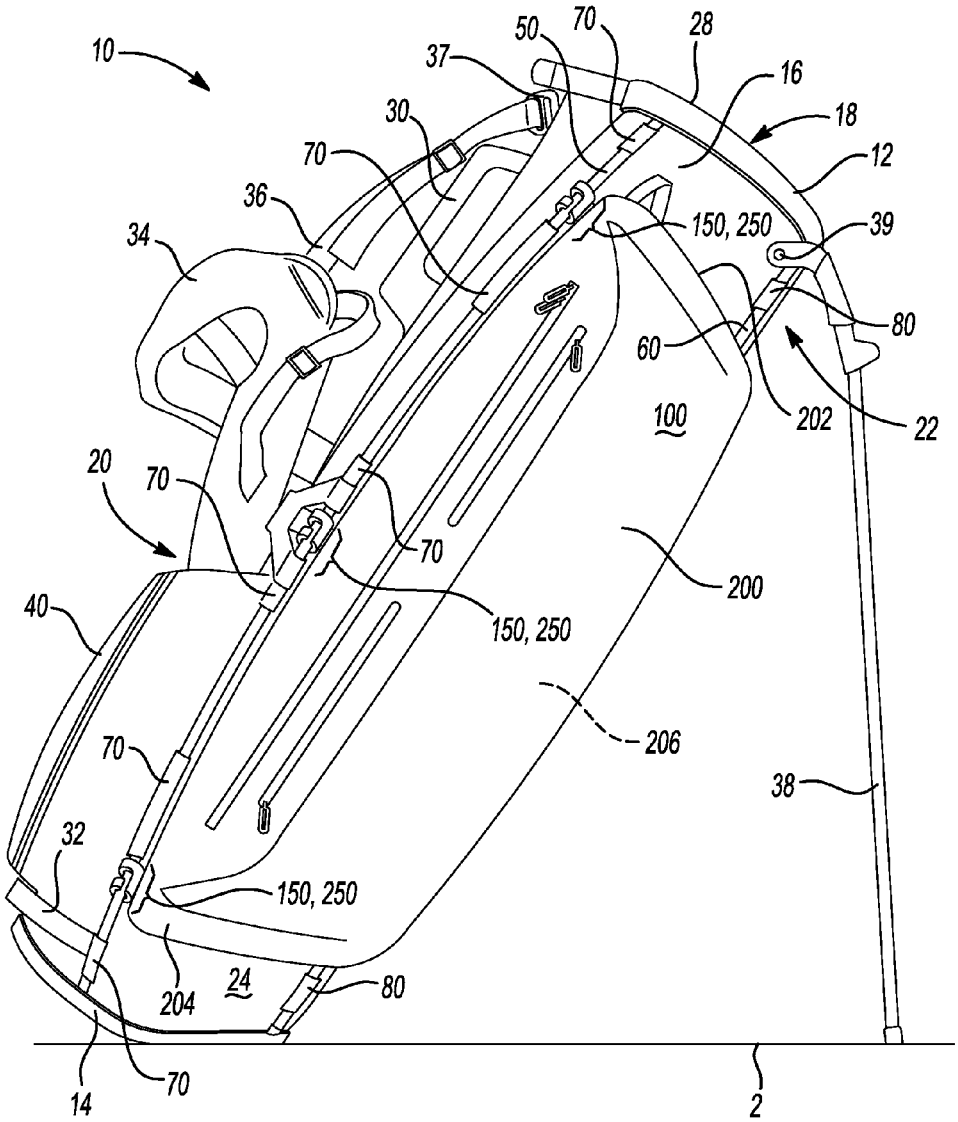
FIG. 1 is a perspective view of a golf bag having a detachable accessory bag in accordance with the principles of the present disclosure.
Figure 2:
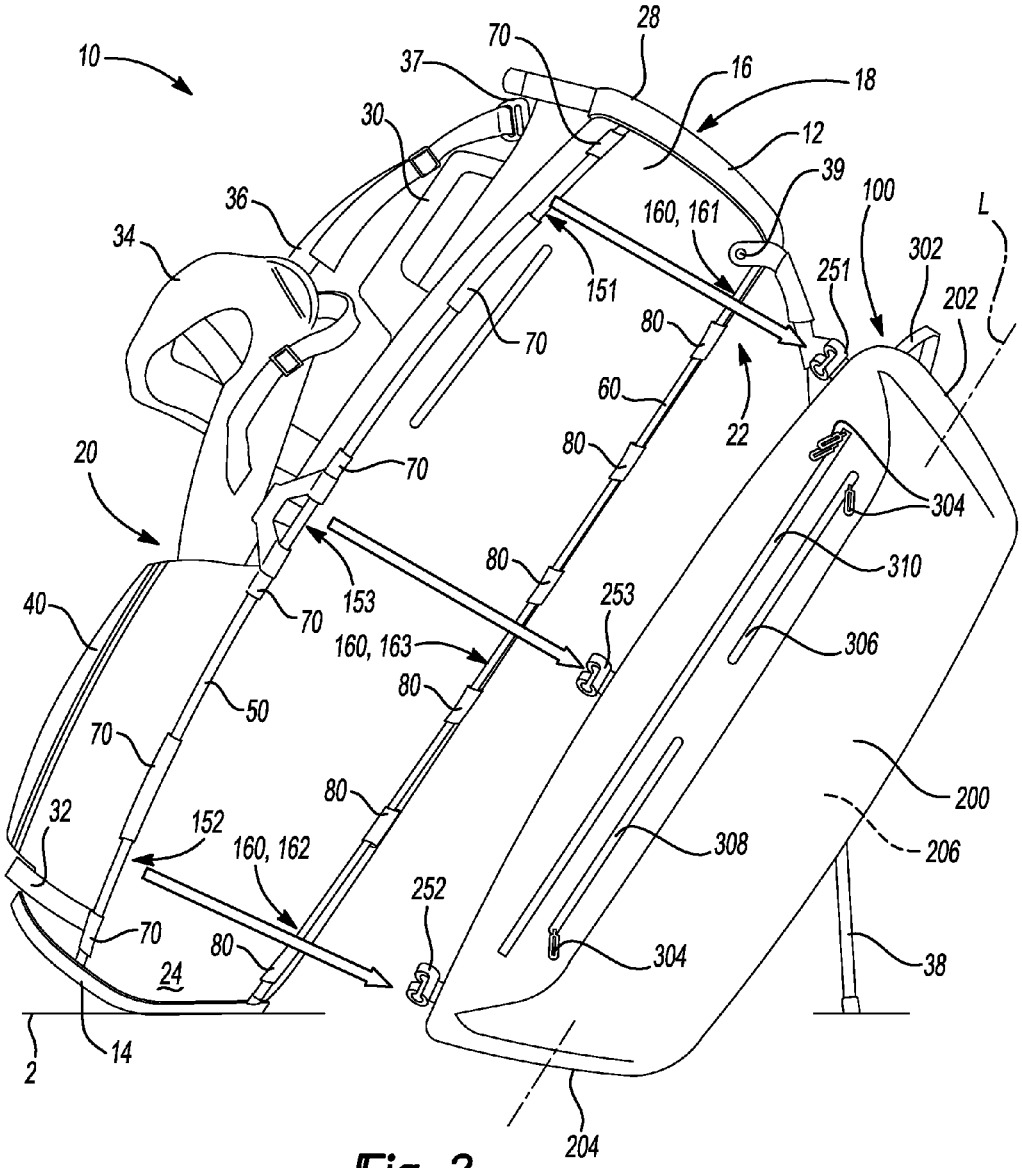
FIG. 2 is a perspective view of the golf bag of FIG. 1 showing the detachable accessory bag detached from the golf bag.

Referring to FIGS. 1 and 2, a golf bag 10 is provided and includes a first support member 12, a second support member 14, a plurality of support rails 50, 60, and a body 16. The golf bag 10 may define a length extending between the first support member 12 and the second support member 14 and may further include a front 20, a rear 22, and opposite sides 24 extending between the front 20 and the rear 22 to define corresponding panels of the golf bag 10 that extend through the length of the golf bag 10.

The plurality of support rails 50, 60 may extend along the length of the golf bag 10 and may connect the first support member 12 and the second support member 14. For example, a proximal end of each support rail 50, 60 may be attached to the first support member 12 and a distal end of each support rail 50, 60 may be attached to the second support member 14. The support rails 50, 60 may extend substantially parallel to one another with at least one of the rails 50, 60 being substantially straight. Additionally or alternatively, at least one of the rails may be slightly curved. The plurality of support rails 50, 60 may be exposed from the golf bag 10 to provide attachment locations 150, 160 for removably attaching accessory bags such as a detachable accessory bag 100 at a location proximate to the visible side 24 of the golf bag 10 in the views of FIGS. 1 and 2. As used herein, an "attachment location" refers to any exposed surface of the support rails 50, 60 that allows attachment to and removal of an accessory bag to and from the support rails 50, 60 of the golf bag 10, as will be described below.

The views of FIGS. 1 and 2 each show the first support rail 50 and the second support rail 60 associated with the visible side 24 of the golf bag 10. The first support rail 50 may be disposed proximate to the front 20 of the golf bag 10, while the second support rail 60 may be disposed proximate to the rear 22 of the golf bag 10. At least one of a third support rail and a fourth support rail (neither shown) may be associated with the opposite side of the golf bag 10 and may be disposed proximate to respective ones of the front 20 and rear 22 of the golf bag 10. Accordingly, the plurality of support rails 50, 60 may refer to three or more support rails. The three or more support rails may be formed from lightweight and sturdy materials. For example, the rails 50, 60 may be formed from materials including, but not limited to, aluminum and/or titanium.

The body 16 may extend between the first and second support members 12, 14, respectively, and may include interior surfaces that define an interior void 18 that receives and holds one or more golf clubs (not shown). A club opening 28 defined by the first support member 12 may provide access to the interior void 18. For example, the club opening 28 may receive a golf club to hold the golf club within the interior void 18 and facilitate entry and removal of the club from and to the interior void 18. In some examples, a portion of the golf clubs received within the interior void 18 may extend out of the interior void 18 and through the club opening 28 defined by the first support member 12. In some configurations, the first support member 12 includes a lip located around the periphery of the club opening 28 that supports a head portion (not shown) of one or more golf clubs received by the interior void 18. In these configurations, the lip may be formed from an abrasion-resistant material to prevent damaging the head portions of the golf clubs in contact therewith. Additionally or alternatively, the first support member 12 may define one or more dividers (none shown) extending across the club opening 28 to define at least two compartments to suitably arrange and organize the golf clubs received within the interior void 18.

The second support member 14 is disposed on an opposite end of the golf bag 10 than the first support member 12 and may include an inner surface and a ground-engaging surface disposed on an opposite side of the second support member 14. The inner surface may support handles (e.g., grips) of each golf club received by the interior void 18 through the club opening 28 defined by the first support member 12. The second support member 14 may be generally oriented to contact a ground surface 2 when the golf bag 10 is not being carried and, therefore, may provide abrasion-resistance and frictional engagement with the ground surface 2. The second support member 14 may be formed from one or more materials that impart durability and wear-resistance, as well as enhance grip with the ground surface 2. For example, rubber may form at least a portion of the second support member 14.

The plurality of rails 50, 60 may be secured to the body 16 to provide structure to the body 16 by holding the body 16 between the support members 12, 14 in a substantially taut manner with panels of the front, rear, and opposite sides 20, 22, 24, respectively, extending between two or more adjacent rails 50, 60. Thus, the plurality of rails 50, 60 are secured to the body 16 to support the body 16 in an open and extended position to allow entry and removal of the golf clubs to and from the interior void 18. In one configuration, the material of the body 16 includes nylon and/or other lightweight and strong natural and/or synthetic materials.

In some implementations, the plurality of rails 50, 60 are located outside of the body 16 and, as such, are each secured to the body 16 at locations substantially on the exterior of the body 16. For example, a first series of sleeves 70 and a second series of sleeves 80 may be attached to the exterior of the body 16 and may respectively receive a portion of the lengths of corresponding ones of the plurality of rails 50, 60. The first series of sleeves 70 may be disposed proximate to the first support rail 50 at the front 20 of the golf bag 10, while the second series of sleeves 80 may be disposed proximate to the second support rail 60 proximate to the rear 22 of the golf bag 10. While not shown in the views of FIGS. 1 and 2, at least one of a third series of sleeves and a fourth series of sleeves may be associated with the opposite side of the golf bag 10 to surround at least a portion of the lengths of corresponding ones of the third and fourth support rails (neither shown) associated with the opposite side of the golf bag 10.

The sleeves of the first series of sleeves 70 may be spaced apart from one another along the length of the golf bag 10. Further, each sleeve 70 is aligned with one another along the length of the bag 10 to allow the first support rail 50 to concurrently extend through each sleeve 70 between the first support member 12 and the second support member 14. Each sleeve 70 surrounds a portion of the length of the first support rail 50 to secure the body 16 to the first support rail 50 in an effort to provide structure to the body 16 (i.e., to place the material of the body 16 under tension).

Similarly, each sleeve of the second series of sleeves 80 may be spaced apart from one another along the length of the golf bag 10. As with the first series of sleeves 70, the sleeves of the second series of sleeves 80 are aligned with one another in a direction extending along a length of the bag 10 to allow the second support rail 60 to concurrently extend through each of the second series of sleeves 80 and between the first support member 12 and the second support member 14. Each sleeve 80 surrounds a portion of the length of the second support rail 60 to secure the body 16 to the second support rail 60 in an effort to provide the aforementioned structure to the body 16.

In other configurations, each series of sleeves 70, 80 may correspond to a single sleeve that runs substantially along the length of its corresponding support rail 50, 60. In such a configuration, the single sleeve includes apertures or holes cut through the sleeve 70, 80 to expose portions of the corresponding support rail 50, 60. The exposed portions may provide attachment locations 150, 160 for removably attaching accessory bags such as the detachable accessory bag 100 to the golf bag 10 via the respective support rails 50, 60. The apertures may be spaced apart from one another along the length of each corresponding support rail 50, 60 to provide attachment locations 150, 160 at various locations along a length of each support rail 50, 60.

In other configurations, the plurality of support rails 50, 60 may be disposed internal to the body 16 and may be secured to the body 16 at locations substantially on the interior surfaces of the body 16 within the interior void 18. Here, the body 16 may include a plurality of slits (none shown) to provide access to the support rails 50, 60 disposed within the interior void 18. Accordingly, the slits formed in the body 16 define attachment locations 150, 160 along a length of each support rail 50, 60 for removably attaching accessory bags such as the detachable accessory bag 100 to the golf bag 10. Thus, slits may be formed in the body 16, and each of the slits may be spaced apart from one another along the length of each corresponding support rail 50, 60.

The golf bag 10 includes one or more retractable legs 38 that selectively support the golf bag 10 in a partially upright position (FIG. 1) on the ground surface 2 when the retractable legs 38 are in a deployed position. For example, each retractable leg 38 may include a proximal end attached to the golf bag 10 at an attachment location 39 disposed proximate to the rear 22 of the golf bag 10 and a distal end that engages the ground surface 2 when the legs 38 are in the deployed position. The retractable legs 38 may move into a retracted position when the golf bag is 10 is lifted off of the ground surface 2, thereby allowing the retractable legs 38 to be positioned adjacent to and substantially parallel with the rear 22 of the golf bag 10.

A grab handle 30 may be located at the front 20 of the golf bag 10 at a location proximate to the first support member 12 to allow the golf bag 10 be carried by a user. Additionally or alternatively, a lift handle 32 may be located at the front 20 of the golf bag 10 at a location proximate to the second support member 14 to allow a user to support the golf bag 10 at the second support member when the bag 10 is carried. One or more accessory storage compartments 40 may be attached to the body 16 or formed therefrom. The one or more accessory storage compartments 40 may be used by a golfer to store golf-related items such as golf balls, tees, and towels, as well as personal items such as beverages, mobile phones, and shoes. The golf bag 10 may also include one or more shoulder straps 34 attached to one or more anchor points 37 disposed on the body 16 via one or more fastening straps 36.

With continued referenced to FIGS. 1 and 2, the detachable accessory bag or pocket 100 is shown as being removably attached to the golf bag 10. FIG. 1 shows the pocket 100 attached to the golf bag 10 and FIG. 2 shows the pocket 100 separated from the golf bag 10. In some examples, the pocket 100 includes a main body 200 defining a storage compartment 206. The main body 200 defines a longitudinal axis L and a length extending between a first end 202 and a second end 204.

The pocket 100 may include a first series of attachment mechanisms 250 each movable between an attached state and a detached state. FIG. 1 shows the first series of attachment mechanisms 250 in the attached state. Here, the first series of attachment mechanisms 250 attach to the first series of attachment locations 150 of the first support rail 50, thereby attaching the main body 200 to more than one attachment location 150 of the golf bag 10. Conversely, FIG. 2 shows each of the first series of attachment mechanisms 250 in the detached state to allow the main body 200 to be separated from the first attachment locations 150 and, thus, from the golf bag 10.

Figure 3:
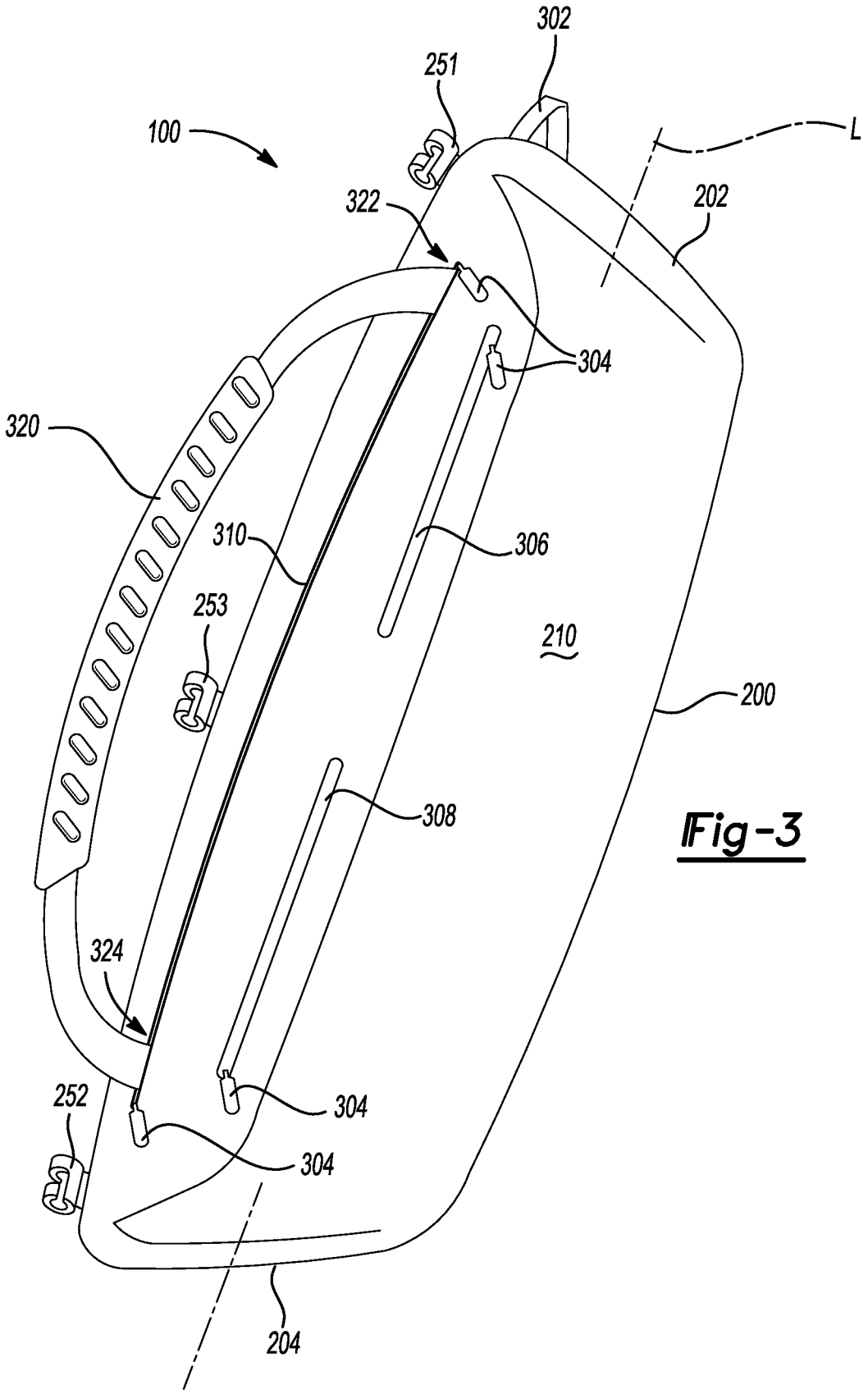
FIG. 3 is a front perspective view of the detachable accessory bag showing a carry mechanism of the detachable accessory bag.

FIG. 3 provides a front perspective view of the detachable accessory bag 100 when the main body 200 is separated from the golf bag 10. In some examples, the main body 200 includes a lift handle 302 disposed proximate to the second end 204. The lift handle 302 allows a user to lift the main body 200 when the main body 200 is separated from the golf bag by applying a force on the main body 200 via the lift handle 302. The main body 200 may also define one or more storage compartments 206. Each storage compartment 206 may be selectively accessed through openings 306, 308 located on a front side 210 of the main body 200. The openings 306, 308 may each be associated with a closure device 304 that selectively closes the openings 306, 308 to prevent access to the particular storage compartment 206. The examples shown in FIG. 3 depict the closure devices 304 as including zippers, however at least one of the closure devices 304 may include a hook-and-loop fastener or any other suitable mechanism that permits selective access to the particular storage compartment.

A carry mechanism 320 may be associated with the accessory bag 100 to allow the main body 200 to be carried separately when the main body 200 is separated from the golf bag 10. In some examples, the carry mechanism 320 includes a strap attached to the main body 200 at a first location 322 and at a second location 324. For instance, the strap 320 may be attached to the main body 200 using fasteners such as stitching, buttons, snaps, hook-and-loop fasteners, and/or any other suitable type of fastener. The second location 324 may be spaced apart from the first location 322 in a direction substantially parallel to the longitudinal axis L of the main body 200. In some examples, the strap 320 may be stored within the main body 200 when the strap 320 is not in use. For instance, FIG. 2 shows an opening 310 formed in the front side 210 that provides access to the storage compartment 206. The strap 320 may be disposed within the storage compartment 206 and may be deployed via the opening 310 when the main body 200 is separated from the golf bag 10. As with the openings 306, 308, the opening 310 may likewise include a closure mechanism 304 that prevents access to the storage compartment 206 and, thus, the strap 320 stored within the main body 200 when the closure device 304 is in a closed state. While the strap 320 is shown and described as being attached to the main body 200 within the storage compartment 206, the strap 320 could alternatively be attached to an exterior surface of the main body 200 via a clip or other suitable fastener.

Referring to FIGS. 2 and 3, in some implementations, the first series of attachment mechanisms 250 includes a first attachment mechanism 251 and a second attachment mechanism 252 each movable between the attached state and the detached state. The first and second attachment mechanisms 251, 252, respectively, may be spaced apart from one another in a direction substantially parallel to the longitudinal axis L of the main body 200. For instance, the first attachment mechanism 251 may be disposed proximate to the first end 202 of the main body 200 and the second attachment mechanism 252 may be disposed proximate to the second end 204 of the main body 200. In some examples, the first attachment mechanism 251 attaches to the first support rail 50 at a first attachment location 151 of the first series of attachment locations 150. Similarly, the second attachment mechanism 252 attaches to the first support rail 50 at a second attachment location 152 of the first series of attachment locations 150. Additionally, the first series of attachment mechanisms 250 may include a third attachment mechanism 253 disposed between the first attachment mechanism 251 and the second attachment mechanism 252 that likewise removably attaches the main body 200 to the first support rail 50 at a third attachment location 153 of the first series of attachment locations 150.

Figure 4:
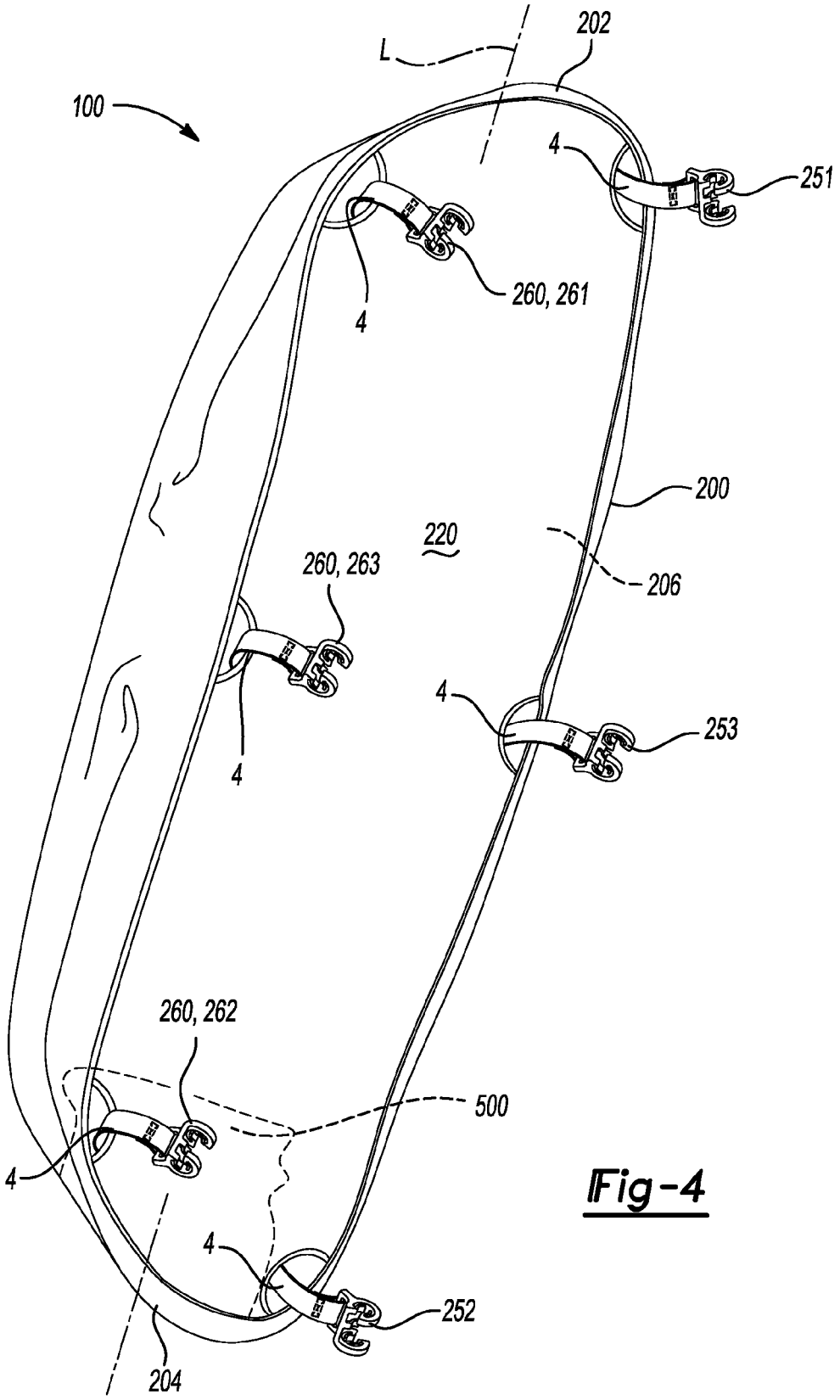
FIG. 4 is a rear perspective view of the detachable accessory bag of FIG. 1 showing a first series of attachment mechanisms and a second series of attachment mechanisms.

FIG. 4 provides a rear perspective view of the detachable accessory bag 100 showing a rear side 220 of the main body 200 disposed on an opposite side of the main body 200 than the front side 210. The first, second, and third attachment mechanisms 251, 252, 253, respectively, may attach to the rear side 220 of the main body 200. In some examples, at least one of the attachment mechanisms 251, 252, 253 attaches to the main body 200 via a corresponding extension strap 4. Here, the extension straps 4 may provide the attachment mechanisms 251, 252, 253 with a degree of movement relative to the main body 200 to help facilitate attachment to and removal from the corresponding attachment locations 151, 152, 153 disposed along the length of the first support rail 50 of the golf bag 10.

In some configurations, the pocket 100 may optionally include a second series of attachment mechanisms 260 each movable between an attached state and a detached state. In the attached state, the attachment mechanisms 260 attach to the second series of attachment locations 160 of the second support rail 60. Accordingly, the attachment mechanisms 260 allow the main body 200 to be selectively attached to the golf bag 10 via the attachment locations 160 of the second support rail 60. As shown in FIG. 4, the second series of attachment mechanisms 260 includes a first attachment mechanism 261 and a second attachment mechanism 262 each movable between the attached state and the detached state. The first attachment mechanism 261 and the second attachment mechanism 262 may be spaced apart from one another in a direction substantially parallel to the longitudinal axis L of the main body 200. For instance, the first attachment mechanism 261 may be disposed proximate to the first end 202 of the main body 200 and the second attachment mechanism 252 may be disposed proximate to the second end 204 of the main body 200.

Referring to FIGS. 2 and 4, the first attachment mechanism 261 attaches to the second support rail 60 at a first attachment location 161 of the second series of attachment locations 160. Similarly, the second attachment mechanism 262 attaches to the second support rail 60 at a second attachment location 162 of the second series of attachment locations 160. The second series of attachment mechanisms 260 may also include a third attachment mechanism 263 disposed between the first attachment mechanism 261 and the second attachment mechanism 262. As with the first attachment mechanism 261 and the second attachment mechanism 262, the third attachment mechanism 263 selectively attaches the main body 200 to the second support rail 60. Specifically, the third attachment mechanism 263 is attached to the second support rail 60 at a third attachment location 163 of the third series of attachment locations 160.

The first, second, and third attachment mechanisms 261, 262, 263, respectively, may be attached to the rear side 220 of the main body 200. In some configurations, at least one of the attachment mechanisms 261, 262, 263 attaches to the main body 200 via a corresponding extension strap 4 in a similar fashion as the attachment mechanisms 251, 252, 253. As with the straps 251, 252, 253, the extension straps 4 may provide the attachment mechanisms 261, 262, 263 with a degree of movement relative to the main body 200, as discussed above with reference to the first series of attachment mechanisms 250. Alternatively, the straps 4 may include a length that places the rear side 220 of the accessory bag 100 under tension when the attachment mechanisms 251, 252, 253, 261, 262, 263 are respectively attached to the support rails 50, 60 to restrict relative movement between the golf bag 10 and the accessory bag 100, as will be described below.

In some examples, the second series of attachment mechanisms 260 extend along the length of the main body 200 substantially in parallel with the first series of attachment mechanisms 250. The second series of attachment mechanisms 260 may be spaced apart from the first series of attachment mechanisms 250 by a separation distance substantially equal to a separation distance between the first support rail 50 and the second support rail 60 of the golf bag 10. Accordingly, the second series of attachment mechanisms 260 may cooperate with the first series of attachment mechanisms 250 to secure the main body 200 to the golf bag 10 when the attachment mechanisms 250, 260 are in their attached states at the attachment locations 150, 160 of the first support rail 50 and the second support rail 60, respectively. Securing the attachment mechanisms 250, 260 to the respective support rails 50, 60 restricts relative movement between the main body 200 and the golf bag 10 when the golf bag 10 is being transported. Such movement may be further restricted if attachment of the mechanisms 250, 260 to the respective support rails 50, 60 places the rear side 220 of the accessory bag 100 in tension. Regardless of whether attachment of the attachment mechanisms 250, 260 to the respective support rails 50, 60 results in the rear side 220 being placed in tension, attachment of the mechanisms 250, 260 to the respective support rails 50, 60 permits the detachable accessory bag 100 to appear integral to the golf bag 10. In other words, while the accessory bag 100 is detachable from the golf bag 10, the accessory bag 100 takes the appearance of a conventional pocket when the bag 100 is attached to the support rails 50, 60 via the attachment mechanisms 250, 260.

The attachment mechanisms 250, 260 may be clips that are formed from a resilient material such as, for example, plastic. The material of the attachment mechanisms 250, 260 allows the mechanisms 250, 260 to be biased into the attached state and resiliently deflected from the attached state into the detached state. For example, a force may be exerted on the attachment mechanisms 250, 260 when the mechanisms 250, 260 respectively engage the support rails 50, 60 due to engagement between the clips 250, 260 and the respective support rails 50, 60. The applied force may cause the clips 250, 260 to deflect and snap onto the support rails 250, 260. Once attached to the support rails 50, 60, the material of the clips 250, 260 causes the clips 250, 260 to securely engage the rails 50, 60. Similarly, when a force is applied to the clips 250, 260 to remove the clips 250, 260 from the rails 50, 60, the clips 250, 260 are once again deflected to permit the clips 250, 260 to be detached from the support rails 50, 60. While the attachment mechanisms 250, 260 are described and shown as being clips, the attachment mechanisms 250, 260 could be any mechanism that permits the accessory bag 100 to be selectively attached to the golf bag 10 via the support rails 50, 60.

With particular reference to FIGS. 5-8, the detachable accessory bag 100 is shown as being used as a so-called range bag that can be configured to hold one or more golf clubs. Advantageously, the accessory bag 100 can be detached from the golf bag 10 for use as a range bag to carry one or more golf clubs in situations when the golfer only needs a few golf clubs and does not desire to carry the larger and heavier golf bag 10. For example, when the golfer goes to a driving range to practice hitting golf shots, the golfer may remove the range bag 100 from the golf bag 10 and use the range bag 100 to carry a few selected clubs to the driving range without having to carry the larger and heavier golf bag 10.

Figure 5:
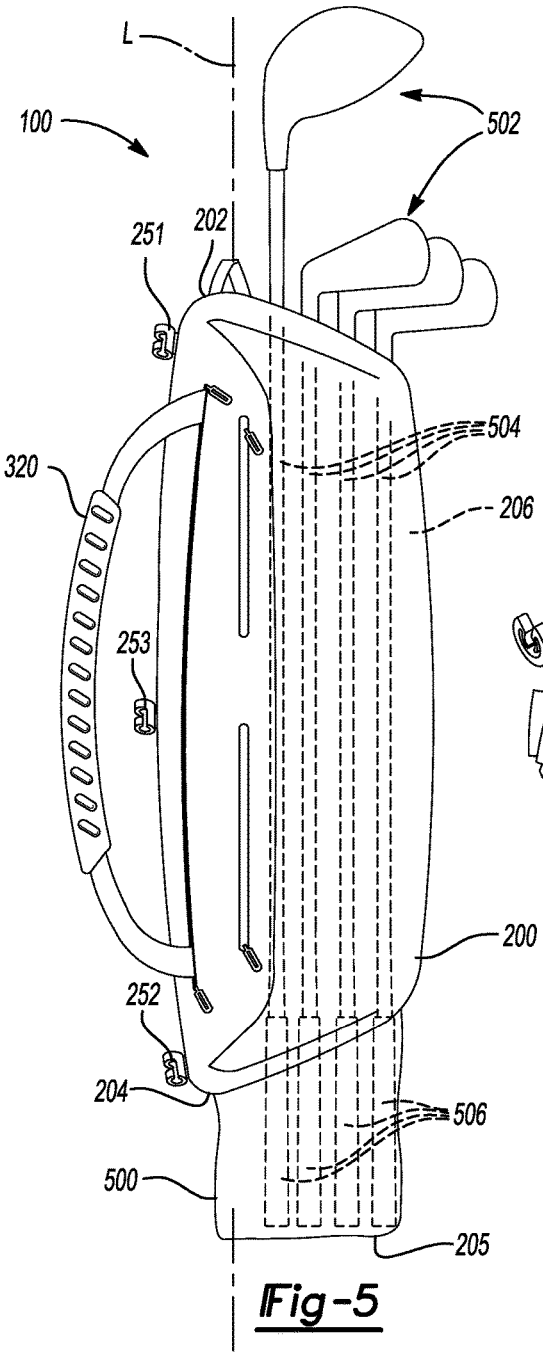
FIG. 5 is a front perspective view of the detachable accessory bag of FIG. 1 in an extended state and holding a plurality of golf clubs.

FIG. 5 is a front perspective view of the detachable accessory bag 100 of FIG. 1 in an extended state and holding a plurality of golf clubs 502. Specifically, the main body 200 may be selectively movable into the extended state to increase a volume of the storage compartment 206 when the main body 200 is separated from the golf bag 10. In some implementations, the detachable accessory bag 100 includes a pocket extension 500 in fluid communication with the storage compartment 206. The pocket extension 500 may be movable between a retracted state disposed within the storage compartment 206 of the main body 200 and an extended state extending from the main body 200.

In operation, the main body 200 may be moved into the extended state by moving the pocket extension 500 stored within the storage compartment 206 into its extended state to increase the volume of the storage compartment 206. While in the extended state, the main body 200 includes an increased length extending between the first end 202 and an extended end 205. As shown in FIG. 5, the extended end 205 extends from the second end 204 and, as such, effectively increases the overall length of the accessory bag 100. The increased length is provided by the pocket extension 500 that is substantially aligned with the longitudinal axis L of the accessory bag 100. The increased volume of the storage compartment 206 allows the accessory bag 100 to hold and carry one or more golf clubs 502. FIG. 5 shows each golf club 502 as having a corresponding shaft 504 received within the storage compartment 206 substantially between the first end 202 and the second end 204 of the main body 200 and a corresponding handle (e.g., grip) 506 received within the storage compartment 206 between the second end 204 and the extended end 205.

Figure 6:
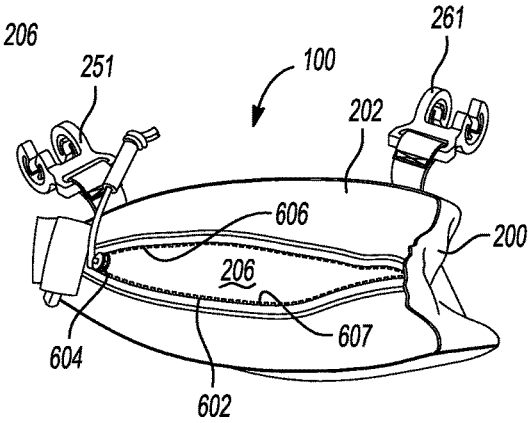
FIG. 6 is a top perspective view of the detachable accessory bag of FIG. 1 showing an end of the detachable accessory bag including a first opening for accessing a storage compartment.

FIG. 6 provides a top perspective view of the detachable accessory bag 100 showing the first end 202 of the main body 200 including a first opening 602 for accessing the storage compartment 206 defined by the main body 200. In some implementations, the first end 202 of the main body 200 includes a first closure device 604 that prevents access to the storage compartment 206 via the first opening 602 in a closed state and permits access to the storage compartment 206 via the first opening in an open state. In some examples, the first closure device 604 includes a zipper operative in the closed state by engaging corresponding teeth of a pair of zipper tracks 606, 607 to close the first opening 602. Conversely, the zipper may be operative in the open state by disengaging the corresponding teeth of the pair of zipper tracks 606, 607 to open the first opening 602, thereby permitting access to the storage compartment 206. In other examples, the first closure device 604 may use any suitable fastener operative to selectively open and close the first opening 602. In other configurations, the detachable accessory bag 100 does not include a closure device at the first opening 602 and, as such, the storage compartment 206 is always accessible via the first opening 602.

Figure 8:
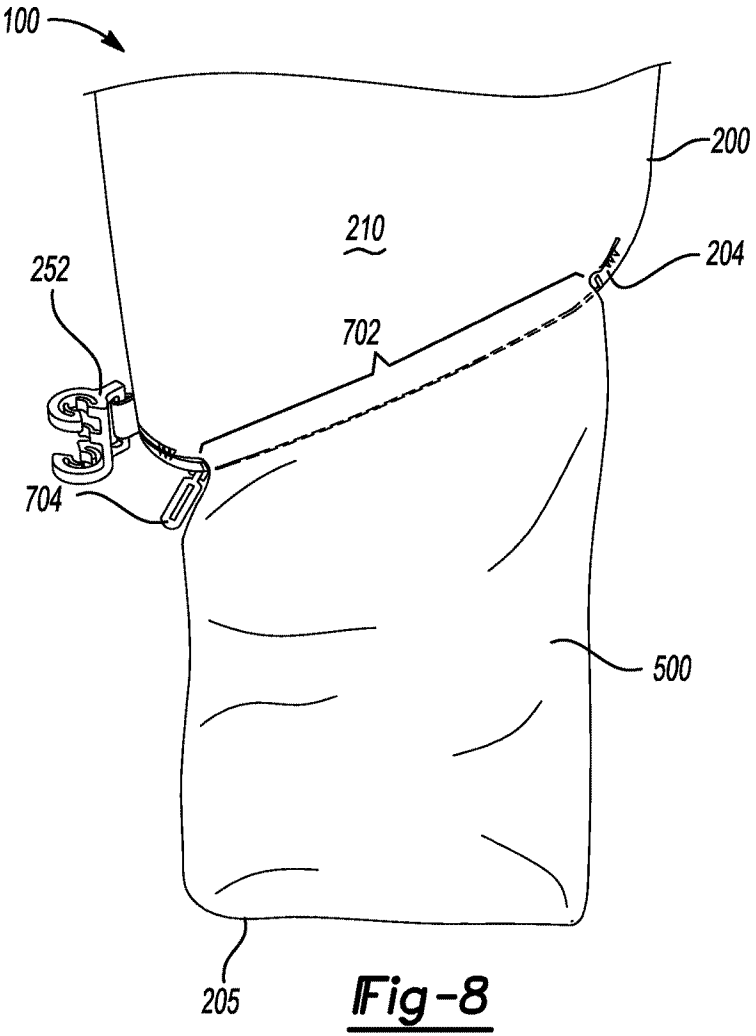
FIG. 8 is a bottom perspective view of the detachable accessory bag of FIG. 1 showing an end of the detachable accessory bag including a movable closure device in an open state to allow a pocket extension to move from a retracted state to an extended state.
Figure 7:
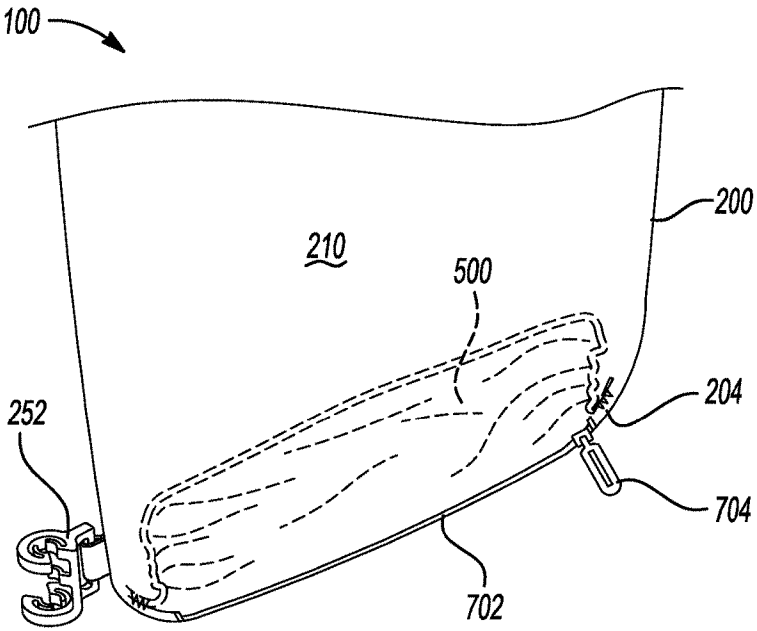
FIG. 7 is a partial bottom perspective view of the detachable accessory bag of FIG. 1 showing an end of the detachable accessory bag including a movable closure device in a closed state to prevent a pocket extension disposed within the detachable accessory bag from moving into an extended state.

FIGS. 7 and 8 are bottom perspective views of the detachable accessory bag 100 showing a second closure device 704 associated with the second end 204 of the main body 200 and movable between a closed state (FIG. 7) and an open state (FIG. 8). Referring to FIG. 7, the pocket extension 500 is shown in its retracted state and disposed within the main body 200. In this view, the second closure device 704 is shown in its closed state preventing access to the pocket extension 500. Accordingly, the pocket extension 500 cannot move from the retracted state into the extended state. In some examples, the second closure device 704 includes a zipper or other suitable fastener that selectively closes an opening 702 of the main body 200 to prevent the pocket extension 500 from moving into the extended state via the opening 702. When the closure device 704 is moved into the open state (FIG. 8), the pocket extension 500 may be removed from the storage compartment 206 and into the extended state via the opening 702.

Referring to FIG. 8, the second closure device 704 is shown in its open state to permit the pocket extension 500 to move from its retracted state to its extended state, thereby increasing the volume of the storage compartment 206 and the length of the main body 200. When in the open state, the second closure device 704 permits access to the pocket extension 500 to permit the pocket extension to be pulled out of the main body 200 via the opening 702 and into the extended state.

Figure 10:
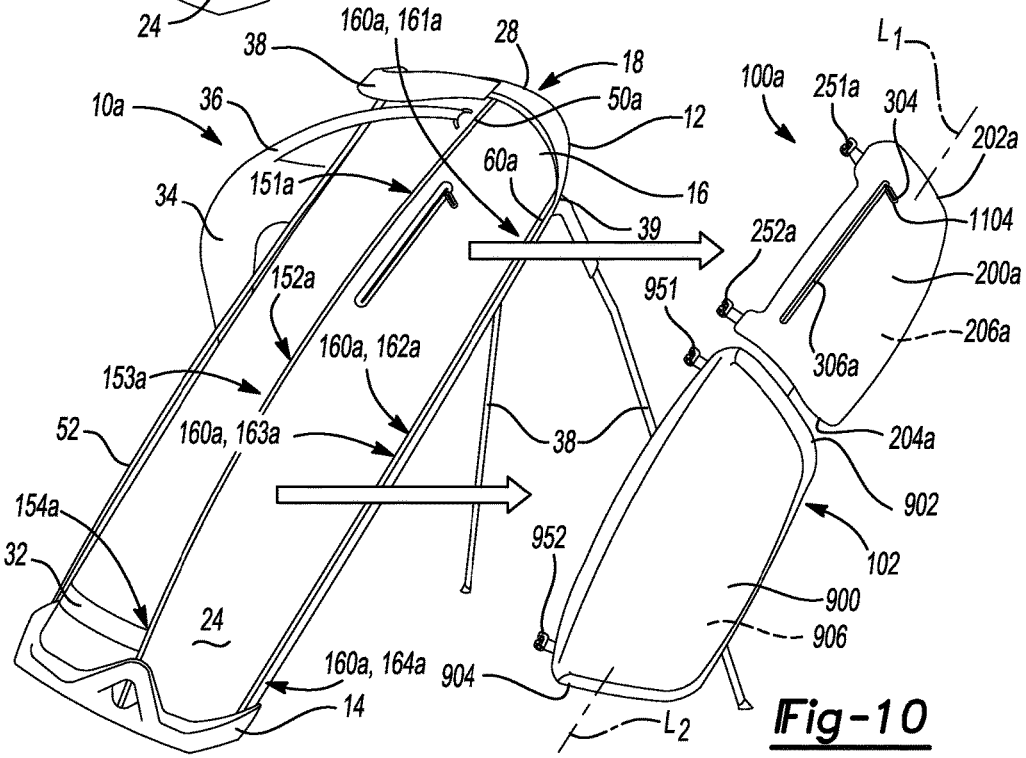
FIG. 10 is a perspective view of the golf bag of FIG. 9 showing the first detachable accessory bag and the second detachable accessory bag detached from the golf bag.

Referring to FIGS. 9 and 10, a golf bag **10*a* is provided. In view of the substantial similarity in structure and function of the components associated with the golf bag 10 with respect to the golf bag 10*a***, like reference numerals are used hereinafter and in the drawings to identify like components while like reference numerals containing letter extensions are used to identify those components that have been modified.

As with the golf bag 10, exposed portions of a plurality of support rails **50*a*, 60*a* provide attachment locations 150*a*, 160*a* for removably attaching an accessory bag to the golf bag 10*a*. For example, the support rails 50*a*, 60*a* provide a location for attaching a first detachable accessory bag 100*a* and a second detachable accessory bag 102 at a location proximate to the visible side 24 of the golf bag 10*a* in the views of FIGS. 9 and 10. The first detachable accessory bag 100*a* may be referred to as a first pocket 100*a* and the second detachable accessory bag 102 may be referred to as a second pocket 102 and either pocket 100*a*, 102 may be attached to the support rails 50*a*, 60*a* at any point along a length of the support rails 50*a*, 60*a*. FIG. 10 provides exemplary attachment locations 151*a*-164*a*. FIG. 9 shows the first accessory bag 100*a* and the second accessory bag 102 attached to the golf bag 10*a* and FIG. 10 shows the first accessory bag 100*a* and the second accessory bag 102 separated from the golf bag 10*a*. The accessory bags 100*a*, 102 may be attached to and separated from the golf bag 10*a*** independently from one another.

The first accessory bag **100*a* includes a first main body 200*a* defining a storage compartment 206*a*. The first main body 200*a* defines a longitudinal axis $L_1$ and a length extending between a first end 202*a* and a second end 204*a***.

The storage compartment 206*a* may be used by a golfer to store various items, as described above with respect to the accessory bag 100.

The second accessory bag 102 includes a second main body 900 defining at least one storage compartment 906. The second main body 900 includes a longitudinal axis $L_2$ and a length extending between a first end 902 and a second end 904. As with the storage compartment 206*a* of the accessory bag 100*a*, the storage compartment 906 may be used to store various items accessible to the golfer. For example, the golfer may store items such as extra garments and/or rain gear within the storage compartment 906. Separating the second accessory bag 102 from the golf bag 10*a* advantageously allows the golfer to pre-pack extra garments and/or rain gear before playing a round of golf. Thus, the second accessory bag 102 may correspond to a conventional duffel bag with the ability to be attached to and removed from the golf bag 10*a* when needed. In some examples, a substantially impermeable liner may line the storage compartment 906 to store wet or dirty garments. Additionally or alternatively, the storage compartment 906 may include a thermal liner for maintaining a desired temperature of items (food or beverages) stored therein. The impermeable liner and the thermal liner are schematically represented by reference number 907 in FIG. 11. For example, the golfer may store food and/or beverages within the storage compartment 906 and a thermal liner 907 may line the storage compartment 906 to maintain a desired temperature of the food and/or beverages stored therein. By allowing the second accessory bag 102 to be removed from the golf bag 10*a*, a golfer may advantageously be permitted to pre-pack food or beverages before playing a round of golf. For example, the golfer may keep the second accessory bag 102 in a refrigerator the night before golfing and then may attach the accessory bag 102 to the golf bag 10*a* when the golfer plays the round of golf the following day. This way, the thermal liner 907 may be chilled and may be used to keep food or beverages disposed within the storage compartment 906 cold.

The first accessory bag 100*a* may include a first series of attachment mechanisms 250*a* each movable between an attached state and a detached state. FIG. 9 shows the first series of attachment mechanisms 250*a* in the attached state. Here, the first series of attachment mechanisms 250*a* attach to a corresponding portion of the first series of attachment locations 150*a* disposed along the length of the first support rail 50*a*, thereby attaching the first main body 200*a* to each corresponding attachment location 150*a* of the golf bag 10*a*. Conversely, FIG. 10 shows each of the first series of attachment mechanisms 250*a* in the detached state to allow the first main body 200*a* to be separated from the corresponding first attachment locations 150*a* and, thus, separated from the golf bag 10*a*.

Referring to FIG. 10, the first series of attachment mechanisms 250*a* associated with the first detachable accessory bag 100*a* includes a first attachment mechanism 251*a* and a second attachment mechanism 252*a* each movable between the attached state and the detached state. The first attachment mechanism 251*a* and the second attachment mechanism 252*a* may be spaced apart from one another in a direction substantially parallel to the longitudinal axis $L_1$ of the first main body 200*a*. For instance, the first attachment mechanism 251*a* may be disposed proximate to the first end 202*a* of the first main body 200*a* and the second attachment mechanism 252*a* may be disposed proximate to the second end 204*a* of the first main body 200*a*. In some examples, the first attachment mechanism 251*a* attaches to the first support rail 50*a* at a first attachment location 151*a* of the first series of attachment locations 150*a*. Similarly, the second attachment mechanism 252*a* attaches to the first support rail 50*a* at a second attachment location 152*a* of the first series of attachment locations 150*a*.

Similarly, the second accessory bag 102 may include a first series of attachment mechanisms 950 each movable between an attached state and a detached state. FIG. 9 shows the first series of attachment mechanisms 950 in the attached state. Here, the first series of attachment mechanisms 950 attach to the first support rail 50*a*, thereby attaching the second main body 900 to each corresponding attachment location 150*a* of the golf bag 10*a*. Conversely, FIG. 10 shows each of the first series of attachment mechanisms 950 in the detached state to allow the second main body 900 to be separated from the corresponding first attachment locations 150*a* and, thus, separated from the golf bag 10*a*.

In some implementations, the first series of attachment mechanisms 950 associated with the second detachable accessory bag 102 includes a first attachment mechanism 951 and a second attachment mechanism 952 each movable between the attached state and the detached state. The first attachment mechanism 951 and the second attachment mechanism 952 may be spaced apart from one another in a direction substantially parallel to the longitudinal axis $L_2$ of the second main body 900. For instance, the first attachment mechanism 951 may be disposed proximate to the first end 902 of the second main body 900 and the second attachment mechanism 952 may be disposed proximate to the second end 904 of the second main body 900. In some examples, the first attachment mechanism 951 attaches to the first support rail 50*a* at a third attachment location 153*a* of the first series of attachment locations 150*a*. Similarly, the second attachment mechanism 952 attaches to the first support rail 50*a* at a fourth attachment location 154*a* of the first series of attachment locations 150*a*.

FIG. 11 provides a front perspective view of the first detachable accessory bag 100*a* and the second detachable accessory bag 102 when the first main body 200*a* and the second main body 900 are separated from the golf bag 10*a*. In some examples, the first main body 200*a* includes one or more carry mechanisms 320*a* that allow the first main body 200*a* to be carried separately from the golf bag 10*a* when the first main body 200*a* is separated therefrom. In some examples, the carry mechanisms 320*a* include straps attached to the first main body 200*a*. For instance, the straps 320*a* may be received by and may rest upon shoulders of a user (e.g., golfer) so that the first main body 200*a* can be worn as a conventional backpack supported by the shoulders of the user. FIG. 11 shows the first main body 200*a* including four straps 320*a* with two of the straps 320*a* attached to the first main body 200*a* on opposite sides of the first end 202*a* and the other two straps 320*a* attached to the first main body 200*a* on opposite sides of the second end 204*a*.

The storage compartment 206*a* may be accessible through a front side 210*a* of the first main body 200*a*. Additionally or alternatively, the storage compartment 206*a* may be accessible via the first end 202*a* and/or the second end 204*a*. In some examples, the first main body 200*a* includes a closure device 1104 that selectively prevents access to the storage compartment 206*a*. For instance, the storage compartment 206*a* may be selectively accessed through an opening 306*a* located on the front side 210*a* of the first main body 200*a* using the closure device 1104. As with the accessory bag 100, the closure device 1104 may include a conventional zipper or other suitable closure device such as, for example, a hook-and-loop fastener.

In some examples, the second main body 900 includes at least one carry mechanism 930 that allows the second main body 900 to be carried separately from the golf bag 10*a* when the second main body 900 is separated therefrom. The carry mechanism 930 includes a strap attached to the second main body 900 at a respective first location and at a respective second location spaced apart from the first location in a direction substantially parallel to the longitudinal axis $L_2$ of the second main body 900. In some configurations, the at least one strap 930 may be used as conventional handle for a user to grasp when transporting the second main body 900 separate and apart from the golf bag 10*a*.

FIG. 11 shows a front side panel 910 cooperating with the second main body 900 to define the storage compartment 906. The storage compartment 906 may include the thermal liner or the substantially impermeable liner 907 for storing wet or dirty garments and/or for storing food and/or drinks. The front side panel 910 may define an opening 916 for accessing the storage compartment 906. In some examples, a closure device 917 may be associated with the opening 916 to selectively close the opening 916, thereby preventing access to the storage compartment 906 via the opening. Similarly, a rear side panel 920 (FIG. 12) may cooperate with the second main body 900 to define another storage compartment 908 located on the rear side of the second main body 900. With reference to FIG. 12, the rear side panel 920 may define an opening 918 for accessing the storage compartment 908. In some examples, a closure device 919 may be associated with the opening 918 to selectively close the opening 918, thereby preventing access to the storage compartment 908 via the opening 918.

Referring to FIG. 12, in some implementations, a rear perspective view of the first detachable accessory bag 100*a* shows a rear side 220*a* of the first main body 200*a* disposed on an opposite side of the first main body 200*a* than the front side 210*a*. The first attachment mechanism 251*a* and the second attachment mechanism 252*a* may attach to the rear side 220*a* of the second main body 900.

In some configurations, the first detachable accessory bag 100*a* may optionally include a second series of attachment mechanisms 260*a* each movable between an attached state and a detached state. In the attached state, the attachment mechanisms 260*a* may attach to a corresponding portion of the second series of attachment locations 160*a* disposed upon exposed along the length of the second support rail 60*a*, thereby allowing the main body 200*a* to attach to each attachment location 160*a* of the golf bag 10*a*. In some implementations, the second series of attachment mechanisms 260*a* includes a first attachment mechanism 261*a* and a second attachment mechanism 262*a* each movable between the attached state and the detached state. The first attachment mechanism 261*a* and the second attachment mechanism 262*a* may be spaced apart from one another in a direction substantially parallel to the longitudinal axis $L_1$ of the main body 200*a*. For instance, the first attachment mechanism 261*a* may be disposed proximate to the first end 202*a* of the main body 200*a* and the second attachment mechanism 262*a* may be disposed proximate to the second end 204*a* of the main body 200*a*. Referring to FIGS. 10 and 12, in some examples, the first attachment mechanism 261*a* attaches to the second support rail 60*a* at a first attachment location 161*a* of the second series of attachment locations 160*a*. Similarly, the second attachment mechanism 262*a* attaches to the second support rail 60*a* at a second attachment location 162*a* of the second series of attachment locations 160*a*.

In some examples, at least one of the attachment mechanisms 251*a*, 252*a*, 261*a*, 262*a* attaches to the first main body 200*a* via a corresponding extension strap 4*a*. Here, the extension straps 4*a* may provide the attachment mechanisms 251*a*, 252*a*, 261*a*, 262*a* with a degree of movement relative to the main body 200*a* to help facilitate attachment and removal to and from the corresponding attachment locations 151*a*, 152*a*, 161*a*, 162*a* disposed along the lengths of the corresponding support rails 50*a*, 60*a* of the golf bag 10*a*. As with the straps 4, the straps 4*a* may include a length that causes the first detachable accessory bag 100*a* and the second detachable accessory bag 102 to be placed under tension when the mechanisms 251*a*, 252*a*, 261*a*, 262*a* are respectively attached to the support rails 50*a*, 60*a*. For example, the rear side 220*a* of the main body 200*a* is placed under tension and relative movement between the first accessory bag 100*a* and the golf bag 10*a* is restricted.

The second series of attachment mechanisms 260*a* may extend along the length of the first main body 200*a* in parallel with the first series of attachment mechanisms 250*a* and may be spaced apart from the first series of attachment mechanisms 250*a* by a separation distance substantially equal to a separation distance between the first support rail 50*a* and the second support rail 60*a* of the golf bag 10*a*. Thus, when the second series of attachment mechanisms 260*a* are attached to the corresponding portion of the second series of attachment locations 160*a* of the second support rail 60*a*, the rear side 220*a* of the first main body 200*a* may be placed under tension and may therefore be restricted from moving relative to the golf bag 10*a* when the golf bag 10*a* is being transported. Regardless of whether the rear side 220*a* is placed under tension when the attachment mechanisms 250*a*, 260*a* are respectively attached to the support rails 50*a*, 60*a*, attaching the attachment mechanisms 250*a*, 260*a* permits the first main body 200*a* to appear integral to the golf bag 10*a* when attached thereto.

Similar to the first detachable accessory bag 100*a*, FIG. 12 also shows the rear perspective view of the second detachable accessory bag 102 having its first attachment mechanism 951 and its second attachment mechanism 952 attached proximate to the rear side panel 920 of the second main body 900. In some configurations, a second series of attachment mechanisms 960, each movable between an attached state and a detached state, attach to the second main body 900. In the attached state, the attachment mechanisms 960 may be attached to a corresponding remaining portion of the second series of attachment locations 160*a* of the second support rail 60*a*, thereby allowing the main body 900 to attach to each corresponding attachment location 160*a* of the golf bag 10*a*. In some implementations, the second series of attachment mechanisms 960 includes a first attachment mechanism 961 and a second attachment mechanism 962 each movable between the attached state and the detached state. The first attachment mechanism 961 and the second attachment mechanism 962 may be spaced apart from one another in a direction substantially parallel to the longitudinal axis $L_2$ of the main body 900. For instance, the first attachment mechanism 961 may be disposed proximate to the first end 902 of the main body 900 and the second attachment mechanism 962 may be disposed proximate to the second end 904 of the main body 900.

Referring to FIGS. 10 and 12, the first attachment mechanism 961 attaches to the second support rail 60*a* at a third attachment location 163*a* of the second series of attachment locations 160*a*. Similarly, the second attachment mechanism 962 attaches to the second support rail 60*a* at a fourth attachment location 164*a* of the second series of attachment locations 160*a*.

In some examples, at least one of the attachment mechanisms 951, 952, 961, 962 attaches to the second main body 900 via a corresponding extension strap 94. Here, the extension straps 94 may provide the attachment mechanisms 951, 952, 961, 962 with a degree of movement relative to the main body 900 to help facilitate attachment to and removal from the corresponding attachment locations 153*a*, 154*a*, 163*a*, 164*a* disposed along the lengths of the corresponding support rails 50*a*, 60*a* of the golf bag 10*a*.

The second series of attachment mechanisms 960 may extend along the length of the second main body 900 in parallel with the first series of attachment mechanisms 950 and may be spaced apart from the first series of attachment mechanisms 950 by a separation distance substantially equal to the separation distance between the first support rail 50*a* and the second support rail 60*a* of the golf bag 10*a*. Thus, when the second series of attachment mechanisms 960 are attached to the corresponding portion of the second series of attachment locations 160*a* of the second support rail 60*a*, the second main body 900 may be restricted from movement relative to the golf bag 10*a* when the golf bag 10*a* is being transported. Moreover, attaching both the attachment mechanisms 950, 960 permits the second main body 900 to appear integral to the golf bag 10*a* when attached thereto.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A pocket for a golf bag, the pocket comprising:

a main body defining a storage compartment extending continuously along a length of said main body between a first end wall defining a first outer surface of said main body and a second end wall disposed at an opposite end of said main body than said first end wall and defining a second outer surface of said main body, said first end wall including a first opening and a first closure device that prevents access to said storage compartment via said first opening in a closed state and permits access to said storage compartment via said first opening in an open state and said second end wall including a second opening and a second closure device that permits a pocket extension disposed within said storage compartment to be moved through said second opening and extend from said second end wall to increase a volume of said storage compartment when said second closure device is in an open state, a longitudinal axis of said main body passing through said first opening, through said second opening, and into said pocket extension;

a first attachment mechanism movable between an attached state attaching said main body to a first attachment location of the golf bag and a detached state allowing said main body to be separated from said first attachment location;

a second attachment mechanism movable between an attached state attaching said main body to a second attachment location of the golf bag and a detached state allowing said main body to be separated from said second attachment location; and a carry mechanism operable to allow said main body to be carried separately from the golf bag when said first attachment mechanism is in said detached state and said second attachment mechanism is in said detached state.

2. The pocket of claim 1, wherein said second attachment mechanism is spaced apart from said first attachment mechanism in a direction substantially parallel to said longitudinal axis of said main body.

3. The pocket of claim 1, wherein said carry mechanism is different than said first attachment mechanism and said second attachment mechanism.

4. The pocket of claim 1, wherein said carry mechanism includes a strap attached to said main body at a first location and at a second location, said second location being spaced apart from said first location in a direction substantially parallel to said longitudinal axis of said main body.

5. The pocket of claim 1, wherein said main body includes a main closure device operable to selectively prevent access to said storage compartment in an area of said main body between said first end wall and said second end wall.

6. The pocket of claim 1, wherein said main body is selectively movable into an extended state to increase a volume of said storage compartment when said first attachment mechanism and said second attachment mechanism are in said detached state and said pocket extension extends from said second end wall.

7. The pocket of claim 6, wherein said extended state provides said main body with an increased length in a direction substantially parallel to said longitudinal axis of said main body.

8. The pocket of claim 1, further comprising a handle attached to said first end wall of said main body.

9. The pocket of claim 1, further comprising a third opening formed on said main body between said first end wall and said second end wall, said carry mechanism movable through said third opening between a stored state within said storage compartment and a deployed state outside of said main body.

10. A pocket for a golf bag, the pocket comprising:

a main body defining a storage compartment extending along a longitudinal axis of said main body between a first end wall defining a first outer surface of said main body and a second end wall disposed on an opposite end of said main body than said first end wall and defining a second outer surface of said main body, said first end wall including a first opening and said second end wall including a second opening, said longitudinal axis of said main body extending through each of said first opening and said second opening;

a first attachment mechanism movable between an attached state attaching said main body to a first attachment location of the golf bag and a detached state allowing said main body to be separated from said first attachment location;

a second attachment mechanism movable between an attached state attaching said main body to a second attachment location of the golf bag and a detached state allowing said main body to be separated from said second attachment location; and a pocket extension in fluid communication with said storage compartment and movable through said second opening from a retracted state disposed within said main body to an extended state extending from said main body at said second end wall, said pocket extension being accessible from said first opening and increasing a volume of said storage compartment when in said extended state.

11. The pocket of claim 10, wherein said second attachment mechanism is spaced apart from said first attachment mechanism in a direction substantially parallel to said longitudinal axis of said main body.

12. The pocket of claim 10, further comprising a carry mechanism operable to allow said main body to be carried separately from the golf bag when said first attachment mechanism is in said detached state and said second attachment mechanism is in said detached state.

13. The pocket of claim 12, wherein said carry mechanism is different than said first attachment mechanism and said second attachment mechanism.

14. The pocket of claim 12, wherein said carry mechanism includes a strap attached to said main body at a first location and at a second location, said second location being spaced apart from said first location in a direction substantially parallel to said longitudinal axis of said main body.

15. The pocket of claim 12, further comprising a third opening formed on said main body between said first end wall and said second end wall, said carry mechanism movable through said third opening between a stored state within said storage compartment and a deployed state outside of said storage compartment.

16. The pocket of claim 10, wherein said main body includes a closure device operable to selectively prevent access to said storage compartment.

17. The pocket of claim 10, wherein said first end wall includes a first closure device that prevents access to said storage compartment via said first opening in a closed state and permits access to said storage compartment via said first opening in an open state.

18. The pocket of claim 17, further comprising a second closure device associated with said second end wall and movable between an open state and a closed state, said second closure device permitting said pocket extension to move into said extended state through said second opening when said second closure device is in said open state and preventing said pocket extension from moving into said extended state when said second closure device is in said closed state.

19. The pocket of claim 10, wherein said pocket extension provides said main body with an increased length in a direction substantially parallel to said longitudinal axis of said main body when said pocket extension is in said extended state.

20. The pocket of claim 10, further comprising a handle attached to said first end wall of said main body.

* * * * *